US011779815B1

(12) United States Patent
Billings

(10) Patent No.: US 11,779,815 B1
(45) Date of Patent: Oct. 10, 2023

(54) ADJUSTABLE AND INTERCHANGEABLE MODULAR HOSEL GOLF CLUB ASSEMBLY

(71) Applicant: Dogleg Rights Partners, LP, McKinney, TX (US)

(72) Inventor: David P. Billings, Savannah, TX (US)

(73) Assignee: Dogleg Right Partners, LP, McKinney, TX (US)

( * ) Notice: Subject to any disclaimer, the term of this patent is extended or adjusted under 35 U.S.C. 154(b) by 0 days.

(21) Appl. No.: 17/743,226

(22) Filed: May 12, 2022

(51) Int. Cl.
*A63B 53/02* (2015.01)
*A63B 53/06* (2015.01)
*A63B 53/04* (2015.01)

(52) U.S. Cl.
CPC ..... *A63B 53/023* (2020.08); *A63B 53/06* (2013.01); *A63B 53/047* (2013.01); *A63B 53/0466* (2013.01); *A63B 53/0487* (2013.01); *A63B 2053/0491* (2013.01)

(58) Field of Classification Search
CPC ..... A63B 53/02; A63B 53/021; A63B 53/022; A63B 53/023; A63B 53/025; A63B 53/026; A63B 53/027; A63B 53/028; A63B 2053/0491; A63B 53/06; A63B 53/047; A63B 53/0466; A63B 53/0487
USPC ..... 473/305–315, 244–248
See application file for complete search history.

(56) References Cited

U.S. PATENT DOCUMENTS 5,275,413 A * 1/1994 Sprague ..... A63B 53/0487 473/337
5,374,064 A * 12/1994 Barber ..... A63B 53/14 473/204
5,997,412 A * 12/1999 Benson ..... A63B 53/00 473/316
6,015,355 A * 1/2000 Angel ..... A63B 60/32 473/313
6,558,269 B1 * 5/2003 McBee ..... A63B 60/00 473/340
7,326,126 B2 * 2/2008 Holt ..... A63B 53/02 473/307
7,354,353 B2 * 4/2008 Hocknell ..... A63B 53/0466 473/307
7,427,239 B2 * 9/2008 Hocknell ..... A63B 53/14 473/307
7,438,645 B2 * 10/2008 Hsu ..... A63B 53/06 473/307
8,235,837 B2 * 8/2012 Bennett ..... A63B 53/0466 473/246

(Continued)

*Primary Examiner* — Sebastiano Passaniti
(74) *Attorney, Agent, or Firm* — David H. Judson

(57) ABSTRACT

A golf club with a multi-piece adjustable and interchangeable modular hosel system comprises a shaft tip connector portion, an upper hosel portion, and optional, intermediate interchangeable hosel adjustment spacer(s). The modular hosel system can be used, for example, with no spacers in place, or one or more risers in each of the hosel adjustability regions. The adjustment spacers can be used to increase the hosel length and shaft axis to head center of gravity offset or intersection. Angled risers can be oriented to adjust the shaft axis relative to club head orientation to fit and adjust specifications including loft and lie angle, alone or in combination. The modular hosel construction provides a quick and efficient means of fitting the putter specification to a large number of golfer requirements and also adjusting the specifications for changing user needs or course conditions.

9 Claims, 9 Drawing Sheets

(56) References Cited

U.S. PATENT DOCUMENTS 8,419,563 B2 * 4/2013 Sander ..... A63B 53/02 473/307
8,535,173 B2 * 9/2013 Golden ..... A63B 53/02 473/288
8,641,547 B2 * 2/2014 Rauchholz ..... A63B 53/06 473/215
8,727,906 B1 * 5/2014 Aguinaldo ..... A63B 53/02 473/246
8,814,718 B1 * 8/2014 Rollinson ..... A63B 60/28 473/299
9,427,639 B2 * 8/2016 Rauchholz ..... A63B 69/3623
10,716,972 B1 * 7/2020 Holtzman ..... A63B 53/0466
2001/0011042 A1 * 8/2001 Roark ..... A63B 60/28 473/288
2004/0018887 A1 * 1/2004 Burrows ..... A63B 53/14 473/307
2005/0227779 A1 * 10/2005 Lenhof ..... A63B 53/02 473/340
2009/0233728 A1 * 9/2009 Liou ..... A63B 53/02 473/307
2010/0041491 A1 * 2/2010 Thomas ..... A63B 53/02 473/316
2011/0177876 A1 * 7/2011 Bennett ..... A63B 53/047 473/307
2012/0142445 A1 * 6/2012 Burnett ..... A63B 53/0466 473/307
2012/0190474 A1 * 7/2012 Sato ..... A63B 53/06 473/409
2013/0324287 A1 * 12/2013 Arluna ..... A63B 53/06 473/324
2015/0231462 A1 * 8/2015 Chapin ..... A63B 60/16 473/300
2015/0273285 A1 * 10/2015 Burch ..... A63B 53/02 473/307
2016/0303437 A1 * 10/2016 Zimmerman ..... A63B 53/02
2018/0361206 A1 * 12/2018 Becktor ..... A63B 60/54
2019/0299066 A1 * 10/2019 Wang ..... A63B 60/42

* cited by examiner

ADJUSTABLE AND INTERCHANGEABLE MODULAR HOSEL GOLF CLUB ASSEMBLY

BACKGROUND

Technical Field

The subject matter herein relates generally to golf clubs and, more particularly, to club head, hosel and shaft constructions.

Description of Related Art

In recent years, a great amount of attention has been given by golf club designers, engineers, and manufacturers towards adjustable features in golf clubs so that the clubs can be adjusted to fit a larger segment of the market and then adjusted at the factory after initial manufacture and for custom orders, by fitters at the point of fitting, by retailers at the point of retail, by golf professional on the driving range or putting green, or by the end user to better fit the user's ideal or preferred specifications. Such adjustment has mostly focused on the ability to change the shaft angle relative to the head and the weighting and Center of Gravity of the heads.

However, there has been very little technological innovation that provides any adjustability for golf clubs that can suit a wider variety of specifications that include club head face loft, shaft lie angle and also shaft axis relative to the club head's center of gravity via bend and hosel length, and to allow the selection, interchangeability of the main portion of the hosel as well as the adjustable mechanisms to provide a wider array of fitting options. The way each golfer swings the club is often varied and dynamic, and changes through time, experimentation or instruction. These are especially true for putters, as golfers use very personal styles, and more readily experiment with different setups, methods and techniques, as well as having different needs, tastes and preferences for ideal model, style, design, shape, weight, balance, materials, colors, aesthetics, etc.

Most club companies only offer irons and putters in particular that are built as one piece and cannot be adjusted at all other than by bending the hosel or shaft using a bending bar and loft and lie machine or vise, or in less precise but relatively common older methods such as stepping on the head while bending the shaft or hosel by hand with force, heating with a torch or friction from a towel to facilitate easier bending, or even slamming against the ground or golf cart tire.

Some manufacturers offer clubs where the hosel (or neck) is interchangeable, especially in drivers and some fairway woods or hybrids. In full swing clubs the newest trend is a shaft and grip that is interchangeable at the juncture of the head and neck (or hosel), and therefore selectable to be able to replace another shaft and grip assembly (usually with a small hosel adaptor sleeve that enables the mechanical juncture between the head and shaft via the adaptor, or connector piece, and also may enable differing shaft angles relative to the head buy using non-concentric attributes of sleeves and rotating collars that further adjust the shaft axis to the receiving receptacle. Some even allow spacers to provide different net length adjustments to the overall length of the club.

However, as noted, the vast majority of these adjustable hosel systems are fixed in that the adjustable features are only selectable within the given, fixed sequence of changes.

The factory, fitter or user has the option to rotate the non-concentric sleeve changes only within a fixed set of parameters.

Furthermore, none of the prior art adjustable systems can be used with existing inventory of heads and interchangeable hosels.

Additionally, none of the prior art devices or systems allow the manufacturer, fitter or user to adjust the shaft plane and the hosel plane independent of one another and in concert to achieve fitting specifications and playability specifications independently or together for expanded levels of adjustment for offset, shaft lean and head loft, lie angle and head center-of-gravity to shaft axis alignment and balance.

Furthermore, it is known that many golfers often have tendencies to more consistently miss shots to the left or to the right. Often this is caused by not closing the face soon enough, resulting in a miss to the right for a right-handed golfer, or by closing the face too soon before impact causing a miss to the left. It is also generally known that the hosel design places the shaft axis in a plane in a relationship to the club head's center of gravity. The proximity of the shaft axis toward the heel places the club head's center of gravity outside the shaft axis, toward the toe. This configuration is often referred to as "toe hang." Clubs with more toe hang (the club head's center of gravity is further away from the shaft axis) can slow down the rate at which the clubs' face closes during the stroke. This is especially important with putters, where the Rules of Golf allow putter hosels and shafts to be connected to the head at locations other than the heel portion of the head.

Heel shafted clubs create a large moment arm where the face typically opens on the back swing and then swings back to square and then past on the forward swing. The timing of getting the face back to square is important in all clubs in order to get the ball to travel in the intended direction after contact. With putters in particular, the face angle has more of an affect on the direction of the putt than the path the putter is swung along, since the swing speed, and head speed is lower than that of most full swing clubs. Therefore, the ability of the golfer to square the face, both at address, and especially at impact is significantly important to the outcome of the putt. However, golfer's body dimensions, posture, setup positions, stroke mechanics, ball position and other factors all play a role in the swing and stroke paths. Putting in particular is also very individual in style and substance. Therefore, the need to be able to fit all the golfers' individual specifications becomes important and a great benefit over fixed putters, or those with only minimal types of adjustment.

Some putter companies have made adjustable lie angle systems that pivot around a single hinge axis. However, these adjustable lie angle systems typically do not provide for additional shaft axis changes that provide for other specification modifications, corrective specification or other expanded levels of adjustment.

Some companies have designed putters with loft adjustment achieved with a selection of interchangeable face plates. However, these usually require multiple attachment screws and can negatively alter the feel with a face that can vibrate, click, or otherwise not feel solid due to the multipart construction in the hitting area where the most force is applied at contact with the golf ball.

Other companies have created adjustable mechanisms to change the angle of the shaft relative to the head, using a angled ring or faceted bushing type connection pieces between the connector portion of the hosel that accepts the shaft tip at one end and the lower portion of the hosel where it intersects and connects with the head, where the hosel adjustment system can change the club face's effective loft higher or lower, in some cases the face angle to open or closed, and in other systems lie angle adjustments as well. The hosel and shaft tip sections of these devices are typically locked in place through the hosel portion with a machine screw or bolt from a recess in the underside of the head. However, these systems are usually limited, or "closed" in that they do not provide the ability to interchange from a selection of different modular hosel pieces, you cannot use the club without the adjustment pieces in place, nor select one or more pieces in combination or no adjustment pieces if so desired.

Furthermore, there is no optional hose length adjustment that can be readily made with these other systems.

In another adjustable hosel device, a jointed or segmented hosel is provided that articulates a segmented hosel so that when different segments are turned, the angle of each segment relative to the others can be adjusted. The hosel of this device is described as having optional interchangeable intermediate sections and having sections that can selectively rotate around the axis of the hosel.

None of the known prior art teaches the ability or a mechanism to quickly and easily interchange the hosel type and length, the shaft and grip of the golf club, nor change the loft, lie, shaft lean and offset and toe hang head balance relative to shaft axis specifications, within the Rules of Golf, to suit an individual golfer's needs and preferences for shaft alignment in relation to head balance, in relation to player setup and stroke tendencies, or the ability to customize the length, or the weight and balance characteristics, of the club in the same device.

Therefore, there is a need for a golf club head, adjustable and interchangeable, modular hosel and shaft construction that provides quick and efficient selection and interchangeability of the individual components from a wide selection of different components, providing adjustability of a large amount of shaft alignment to head orientations, length of the hosel, offset or onset of the shaft to the head, lie angle, loft, shaft lean, length of the shaft and balance of the head relative to the axis of the shaft, by the manufacturer, by a fitter or golf professional or a user, including in a golf course setting, with a single tool or set of tools that can also provide the ability to change the orientation of the grips features relative to the shaft and golf club head.

There is also a need for a golf club head, adjustable and interchangeable, modular hosel and shaft construction that can also provide interchangeability of portions of the modular hosel from a selection of portions, and further refinement of the specifications after installation of the particular hosel.

There is also a need for a golf club with an adjustable and interchangeable, modular hosel and shaft construction that can also provide shaft angle adjustments at the top of the hosel independent from and in concert with the hosel type, and any optional head and modular hosel adjustments and interchangeability at the juncture of the head and hosel.

There is also a need for a golf club head, adjustable and interchangeable, modular hosel and shaft construction that can also provide the ability for the user to better align the orientation of the club head face relative to the hosel, shaft and target line with additional alignment features between the shaft, hosel and club head.

There is also a need for a golf club shaft and grip that can also provide the ability for the user to change the overall length either to increase or decrease the overall length or to compensate for different length modular hose combinations utilized to change the other specifications such as loft, lie, balance and shaft alignment.

There is also a need for a golf club modular hosel construction that can also provide the ability for the user to change the sound and feel aspects of the golf club through the addition or removal of optional dampening devices within the adjustable hosel apparatus.

BRIEF SUMMARY

In one embodiment, a golf club head, multi-piece modular hosel, shaft and grip assembly is provided comprising: a first shaft portion having a grip portion orientated to be grasped by the golfer; a shaft section extending towards the golf club head, an intermediate modular hosel upper stem section at the tip end of the shaft, said upper hosel stem section connected with the hosel upper portion, with one or more optional modular hose riser sections in between the hosel upper portion and the hosel lower portion, said upper portion connected with the lower portion with a mechanical device such as a screw, bolt or key accessed from inside, through or under a bend in the hosel section, said hosel lower portion interchangeably connected to the head portion in a hosel port, wherein the mechanical device connects the hosel and the golf club head.

In another embodiment, a golf club head, modular multi-piece hosel, shaft and grip assembly is provided comprising: a first shaft portion having an outer grip orientated to be grasped by the golfer, an optional intermediate modular hosel upper stem section at the tip end of the shaft, said upper hosel stem section connecting with the hosel upper portion, said hosel lower portion interchangeably connected to the head portion in a hosel port, with one or more optional modular hosel adjustment spacers in between the hosel lower portion and the head hosel port, with the hosel lower portion connected with the head with at least one of a mechanical devise such as a screw, bolt or key accessed from the under side, side and/or top of the golf club head either in connection with or adjacent to the hosel port.

In another embodiment, a golf club head, modular multi-piece hosel, shaft and grip assembly is provided comprising: a first shaft portion having a grip portion orientated to be grasped by the golfer, a modular hosel shaft connector section at the tip end of the shaft, said modular hosel shaft connector section connecting with the hosel upper portion, with one or more optional modular hosel adjustment spacers in between the hosel upper portion and the modular hosel shaft connector portion, said shaft connector section connected with the hosel upper portion with a mechanical devise such as a screw, bolt or key accessed from inside, through or under a bend in the hosel section, said hosel lower portion interchangeably connected to the head portion in a hosel port, with one or more optional modular hosel adjustment spacer sections in between the hosel lower portion and the head hosel port, said lower portion connected with the head with at least one of a mechanical devise such as a screw, bolt or key accessed from the under side, side or top of the golf club head either in connection with or adjacent to the hosel port.

Another aspect of the disclosed subject matter is the ability to change the length of the hosel, and length of the shaft independent of one another as well as the length of the overall club. Being able to change the length of the hosel at the bottom, and/or the top offers distinct advantages not found in other prior art devices. Changing the length at the top of the hosel bend will change the length of the shaft, but not the balance of the head in relation to the shaft axis. Changing the length of the hosel at the base of the hosel will change the balance of the head as it changes the distance from the hosel bend point from the head, and therefore the shaft axis relationship to the head center-of-gravity.

Another aspect of the disclosed subject matter is the ability to change the type of the hosel, with a large selection of different hosel geometries, and still be able to utilize the upper and/or lower adjustment spacers to further, better and more precisely fit, customize and adjust the overall and shaft to head specifications. Being able to change the style of the hosel and selectively choose and orient the adjustment spacers offers distinct advantages not found in other prior art adjustability devices.

The disclosed subject matter provides a multi-piece modular golf club hosel assembly that can have a traditional design, shape and appearance, with a very small, unobtrusive fitting and adjustment mechanism at either end or both ends of the traditional hosel piece. The ability to adjust the shaft angle orientation and specifications independently for lie angle, putter head loft angle, putter head balance relative to the shaft axis and offset and shaft lean is very beneficial for the manufacturer, retailer, fitter, golf professional and the consumer. For instance, the retailer can inventory one model of club that can be fit and adjusted for many different golfers' needs. Furthermore, the golfer can adjust the specifications to suit changing course conditions before or after a round, or when traveling to different courses for instance.

The optional modular hosel shaft tip connector portion can be made separate from the shaft tip section, made to be firmly affixed with the shaft, or made as part of the shaft. The modular hosel shaft tip connector portion can be epoxied to a shaft tip section, or it can be connected in an interchangeable and/or an adjustable construction.

The optional lower hosel shaft connector portion can be a male "shaft in" as in a traditional shaft tip that enters a female cup in the top of the hosel. Or the upper hosel adjustment section The hosel cup section can be made as a female piece where the upper hosel section is a male portion that connects to the inside of the female of multiple pieces. For purposes of this application, by "affixed" is meant that the parts are relatively permanently connected such that they are not separable, including, for example, one-piece construction or parts welded or parts that are firmly epoxied together, press fit together, or some combination for redundancy strengthening and added durability.

The hosel shaft connector portion can be fabricated similarly to a traditional shaft tip, preferably in light weight material such as thin walled steel tubing, aluminum tubing, titanium tubing or graphite tubing or solid rod, or other suitable material and construction. As taught in Billings '604 and Billings '991, modular hosels can be utilized to provide differing shaft alignment configurations such as differing lie angles, head loft specifications, offset, onset or no offset, etc. In the disclosed subject matter, the addition of different combinations of adjustment spacers and their orientations can provide entirely new levels of customization, fitting and adjustability.

In one embodiment, adjustment to loft, lie angle and club head balance such as toe hang, can be achieved separately or in combination using none, one, two or more straight or angled adjustment spacers together at the juncture between the base of the hosel and the hosel port, or stem, or the club head. In another embodiment, an optional selection of straight or angled adjustment spacers is assembled between the tip of the shaft tip or modular hosel shaft tip connector portion, and can be used to adjust the shaft axis angle for adjustment to effective loft, lie angle and club head balance such as toe hang, face balance, or heel hang. The angled or straight adjustment spacers can also be used to adjust shaft length, especially when paired with a selection of differing hosel sections that are longer or shorter.

Another aspect of the disclosed subject matter is that the combination of adjustment betweentheupperhoselportionandthelowerhoselportionadjustmentthatprovidesnewlevels of adjustability not found in other prior art systems. For instance, the lower hosel adjustment can be used to move the hosel portion angle forward toward the toe, to move the shaft alignment closer to the center of the club head, while the upper hosel adjustment can enable the shaft axis to be moved back to realign with the appropriate lie angle suitable to the individual golfer. In this way, the club head shaft axis alignment can be made to be more or less in line with the center of gravity of the head. Or in other words, a hosel can be adjusted from orientations commonly referred to as "toe down" to "face balanced,", or even "heel down," or from face balanced to toe down, heel down, etc. This same system can be used to make the hosel more or less offset, and have the shaft axis remain neutral at 90 degrees vertically straight up from the ground plane, or leaned forward toward the face or back away from the face as may be best suited or desirable for the individual golfer.

Another aspect of the disclosed subject matter is the ability of the optional modular hosel shaft tip connector to be rotated around it's axis as another form of adjustability, so that, for instance if the golfer prefers or wants to experiment with a grip's various geometric features, such as a flat portion for instance, of the grip being orientated upwards toward the golfers chin (usually under the golfers thumbs), or conversely, downward towards the ground (under the fingers), or off to one side such as facing the target or away from the target. By unscrewing locking machine screw, bolt, screw tab or key or other locking mechanism, from under or through the hosel bend section, and rotating the shaft tip or shaft tip connector and engaging a keyed, geared, ratcheting or internal mortised joint, or other type construction; realigning and reengaging and locking the screw, the golfer can quickly and easily make changes to find the best grip alignment for their setup, stroke mechanics and personal preferences.

The hosel port that accepts the hosel and any optional adjustment spacers is preferably mortised, keyed, notched, splined, geared or otherwise designed in such a way as to facilitate the modular parts being firmly attached to one another without any unwanted movement, rattling or vibration. When using a preferred mortised-type joint, the structure can contain a number of sides: a round with a one or more flat sides, a triangle, square, rectangle, pentagon, hexagon, octagon, etc. An illustrated embodiment is a round cornered square exterior geometry and a round inner pass through port. The mortised portion can be located on the top portion of the club head, so that the outermost sides of the adjustment spacers abut the upper edge in a flush manner, or the mortised section can be recessed so that the adjustment spacer or spacers fit down into the recess partially or completely.

Another aspect of this disclosure is the ability to change the shaft lean from standard, counterbalanced or belly to an "arm rest" or "arm lock" style. This is accomplished by either changing at least one of the length, size, shape or material of the butt section. A modular hosel and/or an adjustable/interchangeable shaft tip- or mid-section can also be used for additional combinations and adjustment and interchangeable options. For instance, a modular hosel can be used to adjust the lie angle within a range of optional lie angles. Also, a modular hosel that is easily interchangeable can also allow a forward lean to be incorporated into the golf club to alter the effective loft, or to allow alternative setup, posture and means and methods of holding the club, such as with an Arm Rest or Arm Lock style where the shaft angle is leaned forward to rest against the players leading arm—either inside the arm or across and over the arm or pressed against the arm with the other hand as is known in the game and is approved by the new rules by the USGA and R&A that restrict anchoring to the body but allow anchoring against a player's arm. In this setup, the ability to rotate the grip to place the flat against the arm is an important benefit.

An optional means of adjustment of the length of the shaft and grip section employs a length spacer or set of spacers that fit between the shaft tip section and the upper portion of the hosel that provide different net lengths when installed. Such spacers can be provided in varied lengths, for instance 1⅝ inch, ½ inch and 1-inch lengths, and can be used alone or in combination to provide precise length changes for the overall length of the golf club. The length of the upper hosel adjustment spacers can add length of the overall club without changing the balance of the head and shaft using square or non-angled spacers, or can also change the shaft alignment configurations by using angled spacers in addition to length changes. A longer connection screw, bolt, key or other connection mechanism can be used to allow for the added length. A long screw with deep bore and tapped section of the lower shaft tip connector stem can also facilitate different lengths and heights depending on the number of adjustment spacers selected. The adjustment spacers preferably would also have the same dedicated mortised joints, male on one end and female on the other, to keep the shaft and grip section from rotating around its access when in use. The stem length adjustment can be affixed for use with a locking screw, locking washer, or mechanism such as a spring-loaded tab, latch, threaded collet or other means. A dedicated specialized tool such as a star or Torx® brand by Textron, a 6-lobed drive screw driver, or keyed or pronged collet turning key can be utilized for quick and easy changes by one or all of the manufacturer, retailer, fitter and/or user.

Alternatively, the modular hosel construction can include optional dampening devices such as foam, rubber or other dampening materials in the form of "O-rings", gaskets, inserts or the like and can be designed, sized and positioned to fit inside it's mating sections to dampen the sound and feel of the golf club when it strikes a ball.

BRIEF DESCRIPTION OF THE DRAWINGS

For a more complete understanding of the disclosed subject matter, and the advantages thereof, reference is now made to the following description taken in conjunction with the accompanying drawings, in which:

FIG. 4B illustrates a cutaway view of a selection of modular lower hosel spacers of different adjustment angles in accordance with one embodiment where the varying angles are all located on the bottom portion of the adjustment spacer while all the top angles are square.

DETAILED DESCRIPTION

Figure 1A:
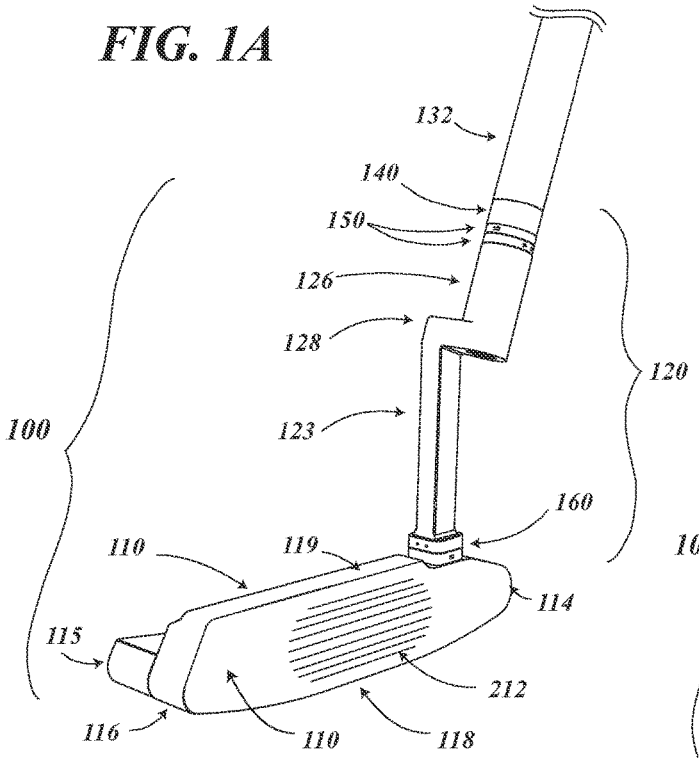
FIG. 1A illustrates a golf club, in this case a putter, having a multi-piece adjustable, modular hosel system, shaft and grip section (not shown), shown from the front of the club in an isometric view, that embodies features of the disclosed subject matter; where the adjustable, selectable interchangeable modular hosel section has a selection of optional lower adjustment spacers between the hosel and the head, and a selection of optional upper adjustment spacers between the shaft and hosel.

Referring to FIG. 1A of the drawings, the reference numeral 100 generally designates a golf club embodying features of subject disclosure, in this case a putter. The golf club head 100 may generally comprise abase head portion 110, a face portion 112, optional grooves 212, a heel portion, 114, a toe portion 116, a sole portion 118 atop portion 119, and a modular hosel portion 120.

The golf club head 100 is shown in a generally finished state and includes an optional interchangeable flange 115 on the back of the putter head. The head 110 or flange 115 can include optional adjustable weights 215 in the head, such as described in U.S. Pat. Nos. 7,828,672 and 7,566,276.

In one embodiment shown in FIG. 1A, the multi-piece modular hosel system comprises a shaft tip 132 at the upper end, a hosel shaft connector piece 140, two optional adjustment spacer ring pieces 150, a hosel cup 126, a hosel elbow 128, a hosel shank 123, and two optional lower hosel adjustment spacer square pieces 160.

Figure 1B:
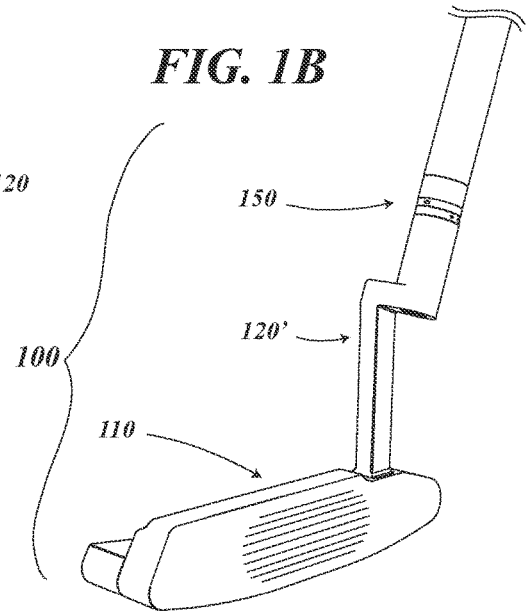
FIG. 1B illustrates a golf club, in this case a putter, having a multi-piece adjustable, modular hosel system, shaft and grip section (not shown), shown from the front of the club in an isometric view, that embodies features of the disclosed subject matter; where the adjustable, selectable interchangeable modular hosel section has a selection of optional upper adjustment spacers between the shaft and hosel.
Figure 1C:
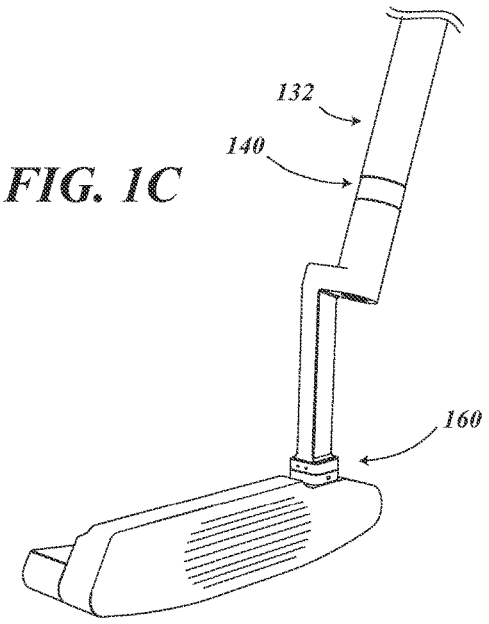
FIG. 1C illustrates a golf club, in this case a putter, having a multi-piece adjustable, modular hosel system, shaft and grip section (not shown), shown from the front of the club in an isometric view, that embodies features of the disclosed subject matter; where the adjustable, selectable interchangeable modular hosel section has a selection of optional lower adjustment spacers between the head and hosel.

FIG. 1B of the drawings shows the same putter 100 as shown in FIG. 1A, with a set of upper modular hosel adjustment spacers, where the hosel 120' is assembled directly into the putter head 110'. FIG. 1C of the drawings shows the example putter from FIG. 1A, shown here with a set of two lower modular hosel adjustment spacer squares 160', where the shaft 132 and hosel shaft connector piece 140 are assembled directly into the hosel cup 126.

Figure 1D:
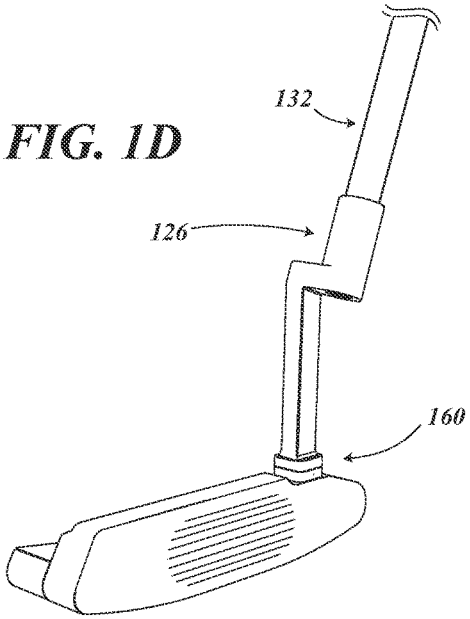
FIG. 1D illustrates the example putter of FIG. 1A with a set of two lower modular hosel adjustment spacers, and where the shaft is assembled directly into the hosel cup.

Referring to FIG. 1D of the drawings shows the example putter from FIG. 1A, shown here with a set of two lower modular hosel adjustment spacers 160', where the shaft 132 is assembled directly into the hosel cup 126.

Figure 2A:
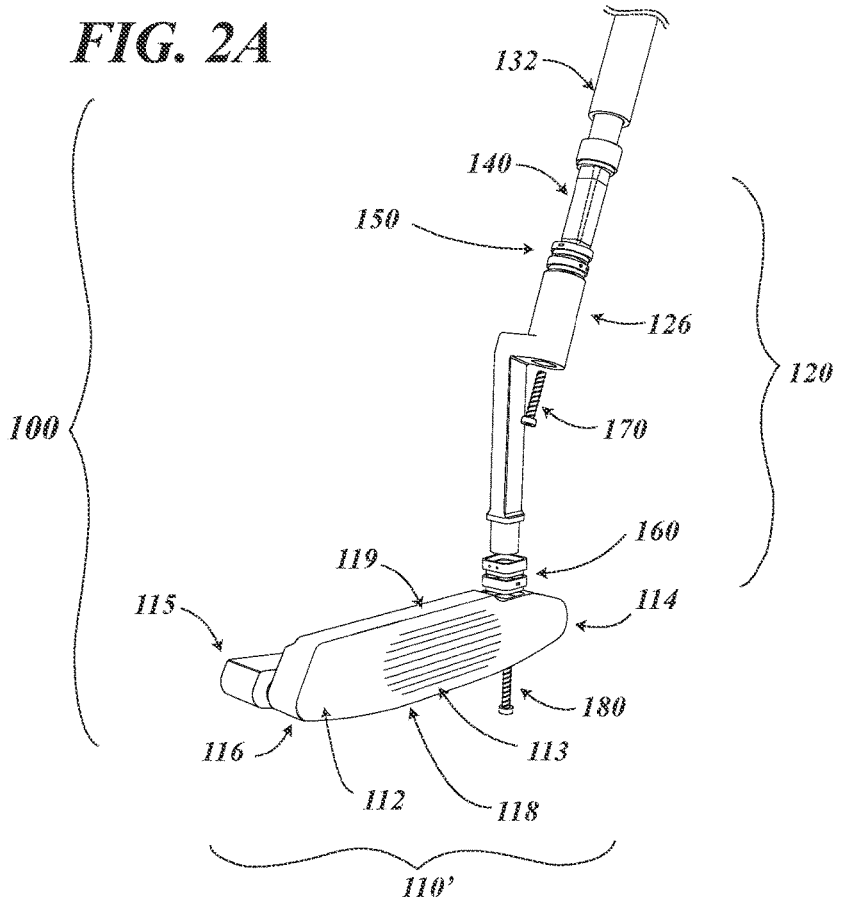
FIG. 2A illustrates a golf club, in this case a putter, having a multi-piece adjustable, modular hosel system, shaft and grip section (not shown), shown from the front of the club in an isometric exploded view, that embodies features of the disclosed subject matter; where the adjustable, selectable interchangeable modular hosel section has a selection of optional lower adjustment spacers between the hosel and the head, and a selection of optional upper adjustment spacers between the hosel shaft connector portion and the main hosel upper section.

Referring to FIG. 2A of the drawings shows the golf club head 100, shaft 132 and a preferred embodiment of an adjustable modular hosel assembly 120 in an exploded view where the individual components are more easily seen, including the hosel shaft connector piece 140, two upper adjustable spacers 150, hosel cup 126, upper connection screw 170, hosel shank 123, lower adjustable spacers 160, head 110' (including face portion 112, grooves 113, heel portion 114, toe portion 116, sole portion 118, and top portion 119), rear flange 115 and lower connection screw 180.

Figure 2B:
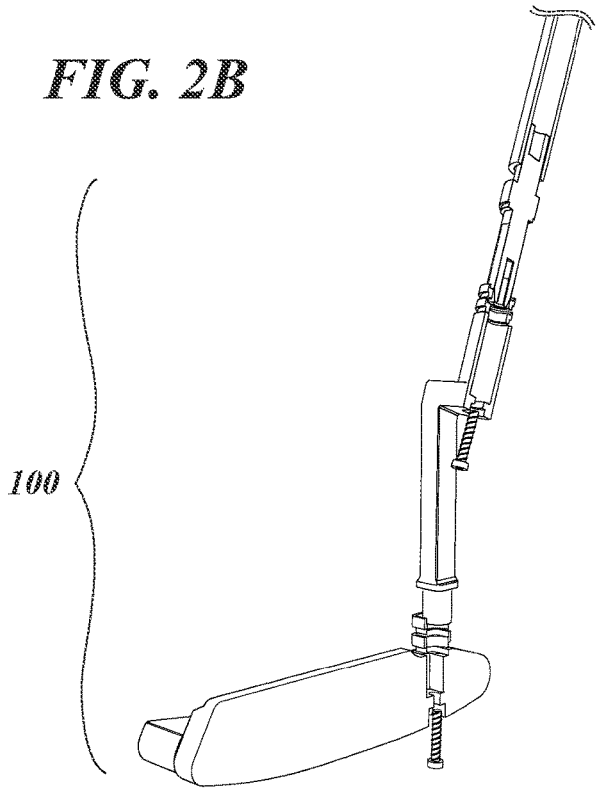
FIG. 2B illustrates a golf club, in this case a putter, having a multi-piece adjustable, modular hosel system, shaft and grip section (not shown), shown from the front of the club in an isometric exploded cutaway view, that embodies features of this disclosure.
Figure 2C:
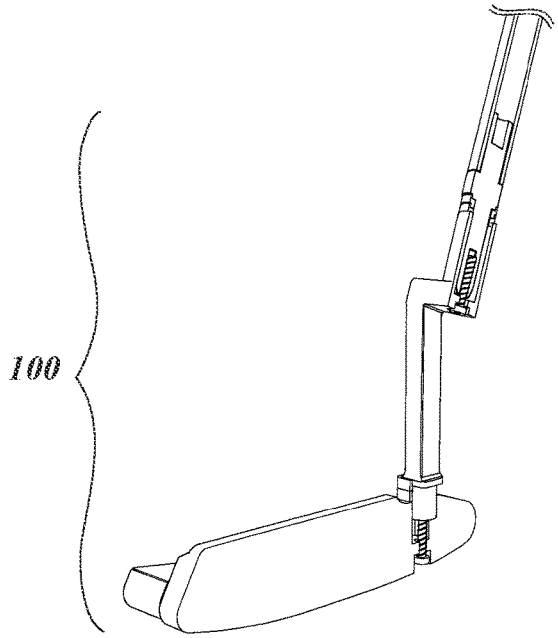
FIG. 2C illustrates a golf club, in this case a putter, having a multi-piece adjustable, modular hosel system, shaft and grip section (not shown), shown from the front of the club in an isometric assembled cutaway view, that embodies features of the disclosed subject matter; where the adjustable, selectable interchangeable modular hosel section has a selection of optional lower adjustment spacers between the hosel and the head, and a selection of optional upper adjustment spacers between the shaft and hosel.

FIG. 2B shows a cutaway view of the same putter head 110 in FIG. 2A with the modular hosel components sliced down the axis of the shaft to reveal the inner construction of the head, hosel and shaft assembly. FIG. 2C shows the same head, modular hosel and shaft in an assembled cutaway view illustrating the fully assembled components.

Figure 3A:
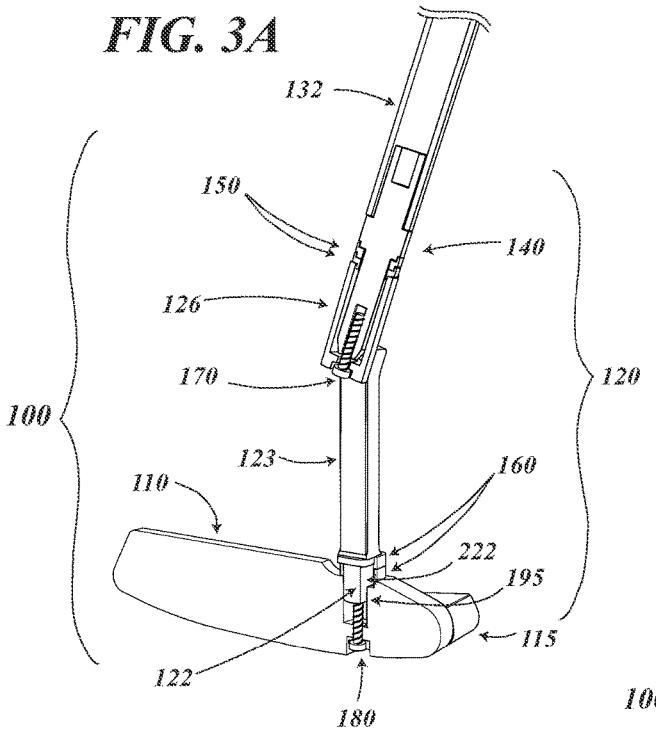
FIG. 3A illustrates a golf club, in this case a putter, having a multi-piece adjustable, modular hosel system, shaft and grip section (not shown), shown from the front of the club nearer the heel in an isometric assembled cutaway view, that embodies features of the disclosed subject matter; where the head, optional lower adjustment spacers and hosel lower stem are joined together with a mechanical screw entering the under side of the head, and where the hosel shaft connector, upper adjustment spacers and hosel upper section are joined together with a mechanical screw located under the hosel upper section's underside.

Referring to FIG. 3A of the drawings shows the golf club 100 in a cutaway view, a head 110, shaft tip end 132, and an adjustable modular hosel assembly 120, including the hosel shaft connector piece 140, two upper adjustable spacers 150, hosel cup 126, upper connection screw 170, hosel shank 123, lower adjustable spacers 160, lower hosel stem 122, lower hosel stem flat 222, head hosel port flat 195, rear flange 115 and lower connection screw 180.

Figure 3B:
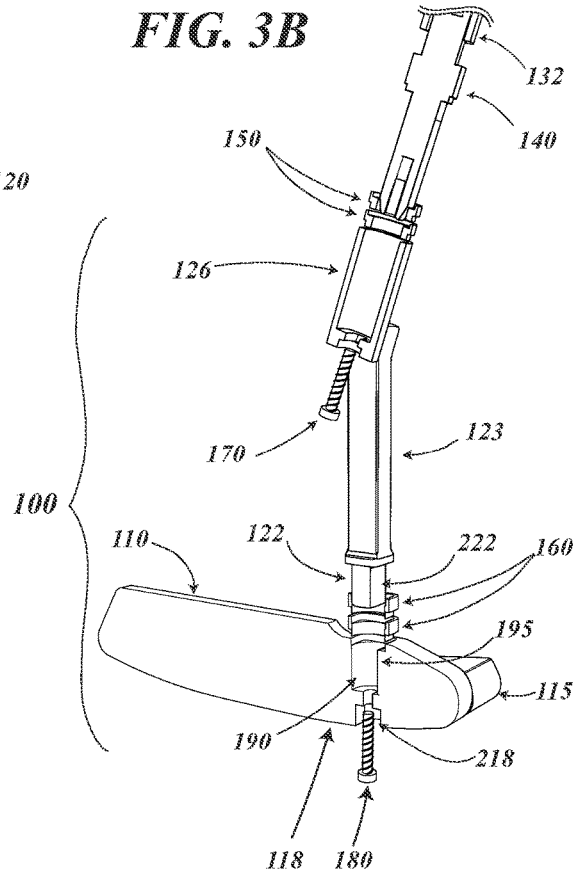
FIG. 3B illustrates a golf club, in this case a putter, having a multi-piece adjustable, modular hosel system, shaft and grip section (not shown), shown from the front of the club in an isometric exploded cutaway view, that embodies features of the disclosure.
Figure 3C:
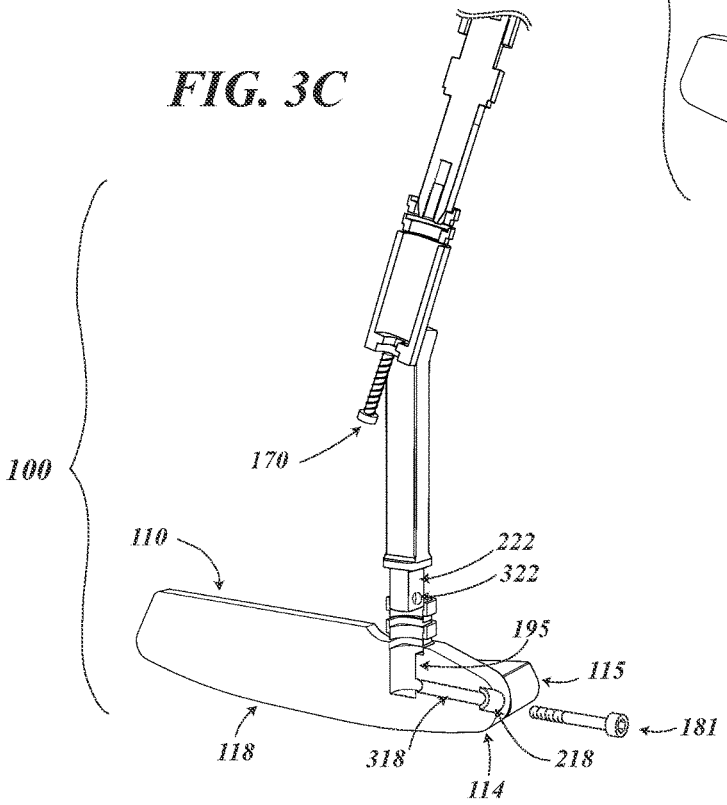
FIG. 3C shows the example putter from FIG. 3A, and shown here with an alternative means to secure the modular hosel lower stem via a hosel connection bolt located in a heel portion of the head.

FIG. 3B of the drawings shows the same golf club 100 in 3A, here in an exploded cutaway view showing the club head 110, shaft 132 the hosel shaft connector piece 140, two upper adjustable spacers 150, hosel cup 126, upper connection screw 170, hosel shank 123, lower adjustable spacers 160, the head's hosel port 190, lower hosel stem 122, lower hosel stem flat 222, head hosel port flat 195, rear flange 115, the head's hosel port counter sink 218 in the sole 118, and lower connection screw 180. Note that the hosel port 190' can be located in a variety of locations in the head, as seen in FIG. 3C where a hosel connection bolt 181 is located in the heel portion 114 of the head, for instance, instead of the sole 118. Additionally, a side screw or pin can be threaded through the head and compress against the hosel stem, or a pass-through clearance bore and threaded into the hosel stem. The hosel port counter sink 218 could be located in the flange 115, or other portions of a multi-piece head design, especially in putters where the USGA and R&A Rules governing club design allow various hosel positions. Additionally, there could be multiple hosel connection ports and screws to provide a redundant system that can provide another means for locating the hosel in the correct orientation with the head to confirm to the Rules, and to provide extra strength and reliability of the parts remaining connected for play and over time. Similarly, the hosel port countersink 218 and lower connection screw 180 or bolt 181 can also be located under or adjacent the hosel port in whatever location the two can be connected allowing access and a secure mechanical construction.

Figure 4A:
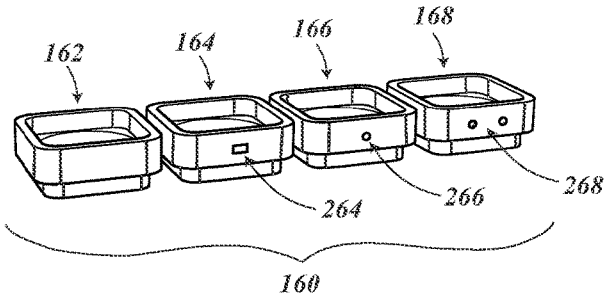
FIG. 4A illustrates a selection of modular lower hosel spacers of different angles in accordance with one embodiment where the varying angles are all located on the top portion of the spacer.

FIG. 4A illustrates an isometric view of a selection of lower adjustment spacers 160. Adjustment spacer 162 has no marking on its outermost surface designating zero angle change. Adjustment spacer 164 has ½ degree of change and is marked with a hash mark 264 on the outer surface adjacent the direction of lean. Adjustment spacer 166 has one degree of change and is marked with a single dot 266. Adjustment spacer 168 has two degrees of angle change and is therefore marked with two dots 268 to designate its geometry and orientation.

Figure 4B:
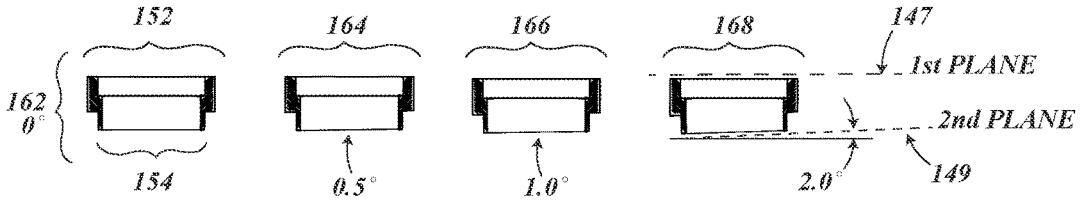
FIG. 4B illustrates an alternative design where both the top and bottom of the spacer are angled.
Figure 4C:
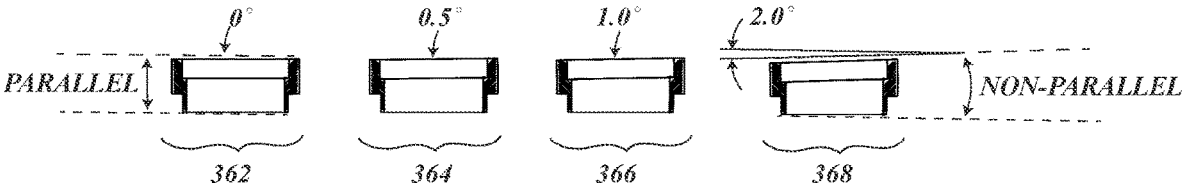
FIG. 4C illustrates an alternative design where both the top and bottom of the spacer are angled.
Figure 4D:
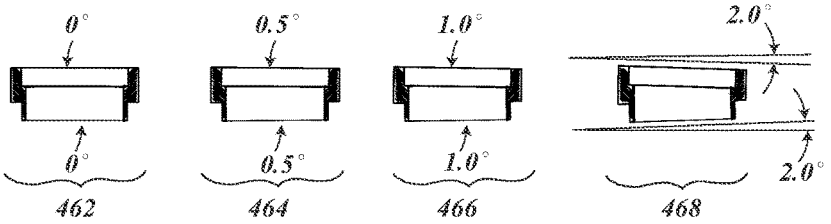
FIG. 4D illustrates an alternative design where both the top and bottom of the spacer are angled.

FIG. 4B illustrates a cutaway side view of a selection of lower adjustment spacers 162, 164, 166 and 168, manufactured according to the preferred embodiment. Adjustment spacer 162 is square with no angle differentiation between the top female mortised recess 152 and the lower male tenon section 154. Preferably, the selection of different angled spacers is provided with angles by CNC machining the female mortised joints uniformly on all pieces from a larger stock piece. The lower male tenon section is then milled in a second operation to produce the amount of change. Thus, the adjustment spacer has a top female mortised recess having an opening along a first plane 147, and a male tenon section having an opening along a second plane 149. Alternate designs can be seen in FIG. 4C and FIG. 4D. In 4C, the amount of change is milled into the upper mortice recess and surrounding walls, with the result that the planes 147 and 149 may be parallel or non-parallel as also indicated. In FIG. 4D, change is provided in both the upper and lower sides of the adjustment spacers simultaneously. It should be noted that the adjustment spacers could also be manufactured with a compound angle where the degree of change is orientated in two directions simultaneously, providing both loft and lie angle changes in one adjustment spacer, in addition to changes in balance of the head relative to the shaft axis depending tip on the spacer length and location. However, for simplicity and ease of use across a broad spectrum if customers and end users, a single angle of change orientated to a single marked side is preferred.

Figure 5A:
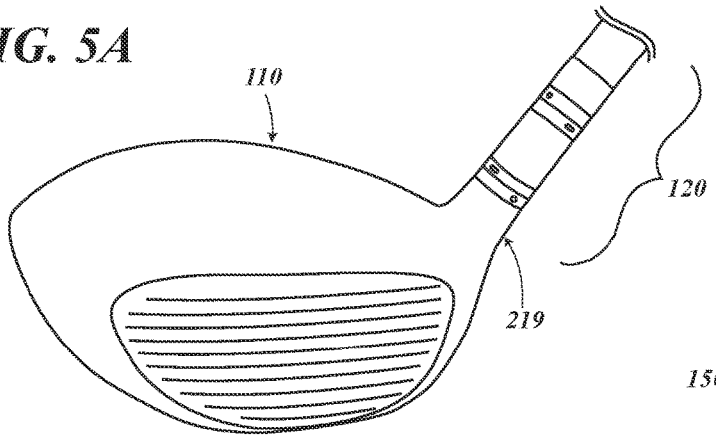
FIG. 5A illustrates a golf club, in this case a driver or fairway wood, having a multi-piece adjustable, modular hosel system, shaft and grip section (not shown), shown from the front of the club in an assembled, isometric view, that embodies features of the disclosure; where the adjustable, selectable interchangeable modular hosel section has a selection of optional lower adjustment spacers between the main portion of the hosel and the head, and a selection of optional upper adjustment spacers between the upper hosel portion and a hosel shaft connector portion.
Figure 5B:
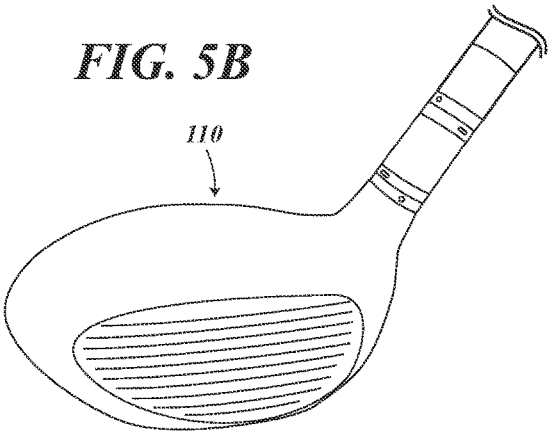
FIG. 5B illustrates a golf club, in this case a fairway wood, having a multi-piece adjustable, modular hosel system, shaft and grip section (not shown), shown from the front of the club in an isometric view.
Figure 5C:
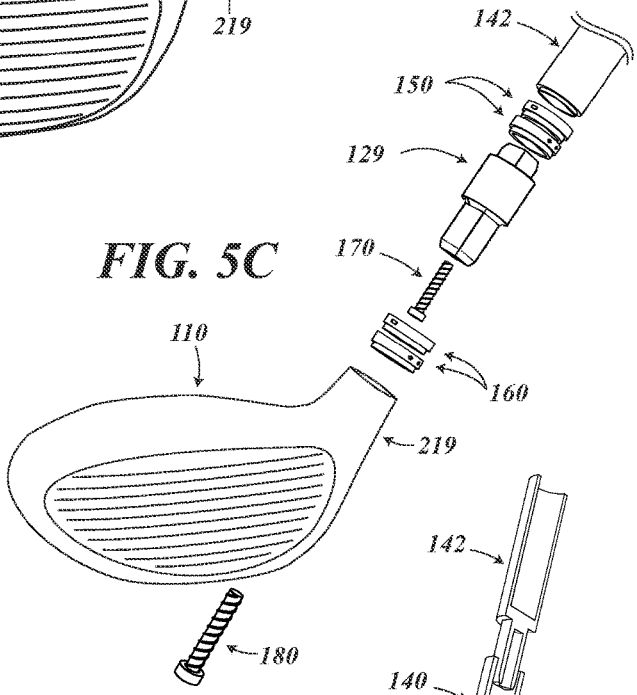
FIG. 5C illustrates a golf club, in this case a fairway wood or hybrid wood—iron, having a multi-piece adjustable, modular hosel system, shaft and grip section (not shown), shown from the front of the club in an exploded isometric view.

FIG. 5A illustrates a driver or fairway wood club 100 (grip not shown), and where the modular hosel section 120 can have a smooth flush construction where all the exterior surfaces can generally have the same outer shape and diameter from the shaft tip 132 to the club head hosel section 219 as also shown in FIG. 5B showing a fairway wood head 110 that embodied features of a preferred embodiment. FIG. 5C shows an exploded view of a fairway wood or hybrid wood-iron type head 110, and a hosel shaft connector 142, a set of upper adjustment spacers 150, a hosel mid-section 129 an upper connection machine screw 170, a lower set of adjustment spacers 160 the club head 110 and a lower connection screw 180. The lower adjustment spacers 150 and upper adjustment spacers 160 can be the same size and shape and be interchangeable for efficiency of manufacture, inventory, distribution, sale, utility and use.

Figure 6A:
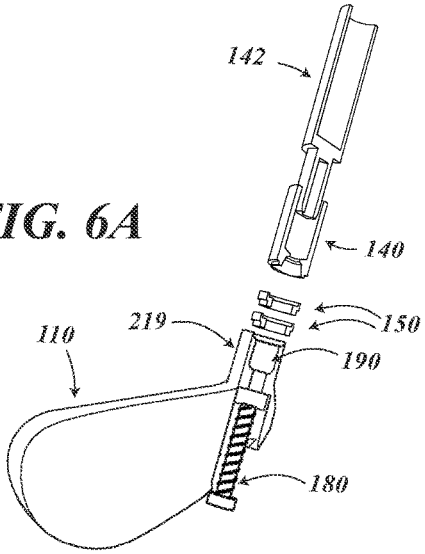
FIG. 6A illustrates a golf club, in this case an iron, having a multi-piece adjustable, modular hosel system, shaft and grip section (not shown), shown from the front of the club in an assembled cutaway isometric view.

FIG. 6A illustrates a hybrid, utility-iron or standard iron-type head 110 in an exploded cutaway view showing a preferred embodiment with a shaft connector piece 142, a hosel mid-section 140, a set of two lower adjustment spacers 150, the club head hosel stem portion 219, hosel port 190 and lower connection screw 180.

Figure 6B:
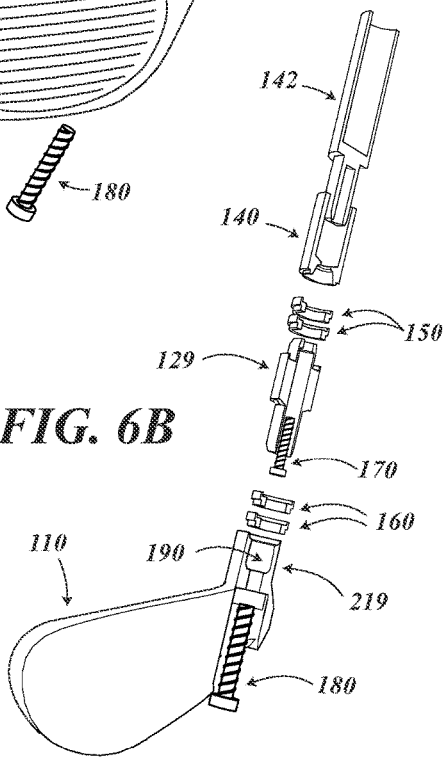
FIG. 6B illustrates a golf club, in this case an iron, having a multi-piece adjustable, modular hosel system, shaft and grip section (not shown), shown from the front of the club in a cutaway exploded isometric view.
Figure 7:
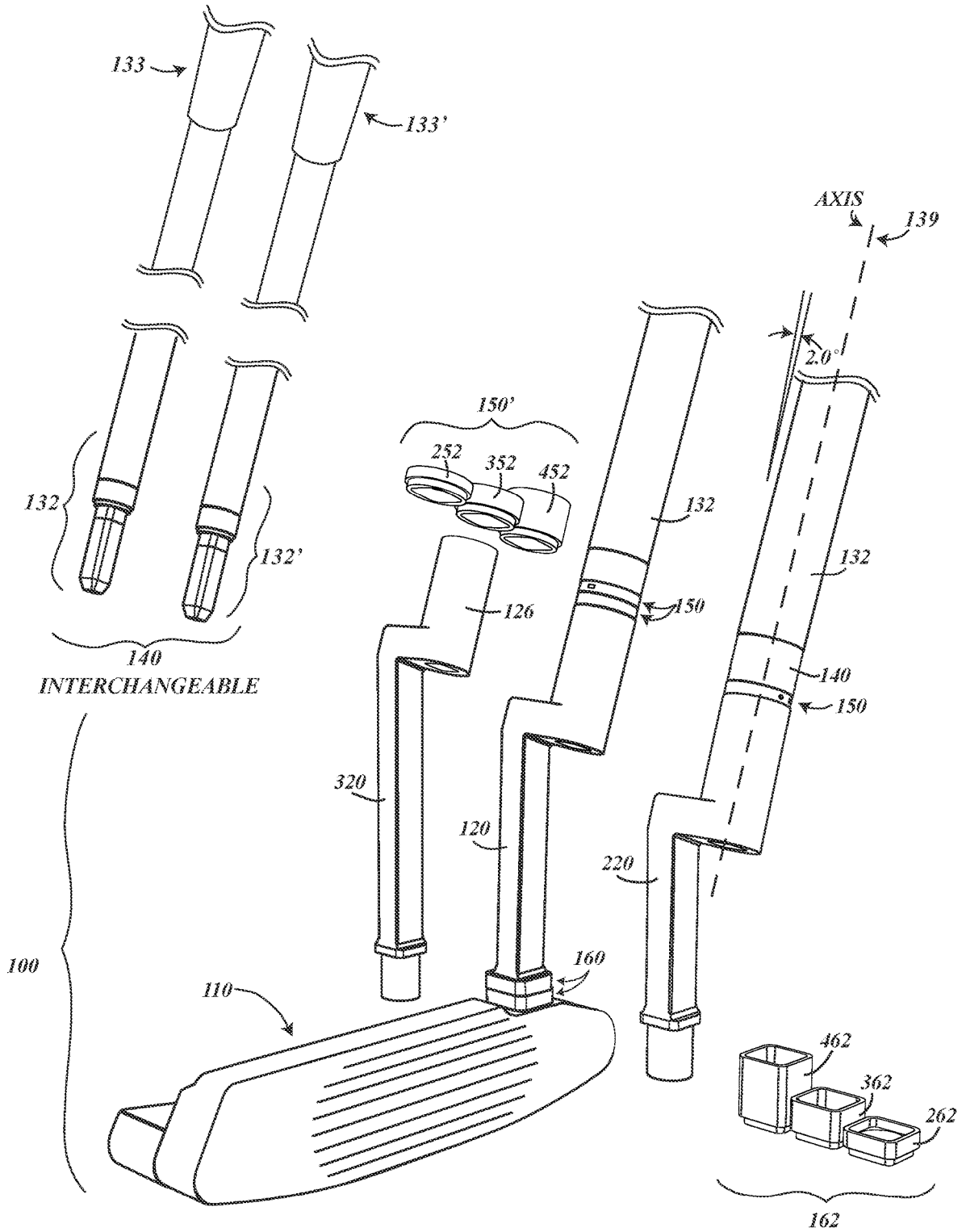
FIG. 7 illustrates an exploded view of a golf club, in this case a putter, having a multi-piece adjustable, modular hosel system, shaft and optional grip section (partially shown), shown from the front of the club, where there is a selection of interchangeable shafts assembled with hosel shaft tip connectors, a selection of upper hosel adjustment spacers, a selection of hosels of varying length, the medium length being installed in the head with a pair of lower hosel adjustment spacers, and a selection of optional lower hosel length adjustment spacers.

FIG. 6B illustrates a hybrid, utility-iron or standard iron-type head 110 in an exploded cutaway view showing an alternative embodiment with an upper hosel shaft connector piece 142, a hosel upper mid-section 140, a set of two upper adjustment spacers 150, a hosel mid-section connector piece 129, an upper connection screw 170, a set of lower adjustment spacers 160, a hosel port 190, a head hosel stem portion 219, the club head hosel stem portion 219, hosel port 190 and lower connection screw 180;

FIG. 7 illustrates an exploded view of a golf club 100, showing a selection of interchangeable hosel shaft connectors 140 assembled with shaft tips 132 and 132' (and the associated grips 133 and 133'), a selection of upper adjustment spacers 150 in different lengths 252, 352 and 452, a hosel 120 assembled with a pair of lower hosel spacers 160, and an additional selection of different length hosels including a longer hosel 320 and shorter hosel 220, the medium length being installed in the head with a pair of lower hosel adjustment spacers, a selection of optional lower hosel length adjustment spacers 162 with 262 being 1/16" high, 362 being 1/4" high and 462 being 1/2" high net adjustment length when assembled, and an axis 139 of the shaft and grip portion that is formed by a combination of the shaft and the grip;

As noted, adjustment spacers are provided in different lengths, and different degrees of change, and can be used alone or stacked, allowing the club to be adjusted for loft and lie angles independent of one another, or in combination. The orientation of the angled side of the adjustment spacer determines the specification change to the assembled golf club. For instance, with the degree of angle change from level, positioned toward the toe 116 will cause the shaft angle to change one degree upright. If a two degree spacer is oriented towards the face, that will create two degrees more effective. As can be seen in FIG. 4A the preferred embodiment includes a selection of spacers that include one square lower adjustment spacer 162, one 0.5 (1/2) degree of change lower adjustment spacer 164, one degree (1°) 166, and two degrees (2°) 168. Other degrees of change such as 0.25 degree (1/4°), 0.75 degree (3/4°) or 1.5° or three degree (3.0°), for instance, are all possible. By stacking the adjustment spacers in the same direction, it is possible to increase the adjustment.

The shaft can be connected to the golf club directly with a standard or specialized tip section, either formed as part of the shaft or affixed or connected to the shaft tip. The shaft tip or tip section can then be connected to the head or with a hosel, with optional upper or lower adjustable modular spacers between the shaft tip or shaft tip connector and the head or hosel. An optional hosel portion can be modular and interchangeable with the head as taught in Billings' '276, '604 and '991, providing further levels of customization, fitting options and adjustment.

Figure 8A:
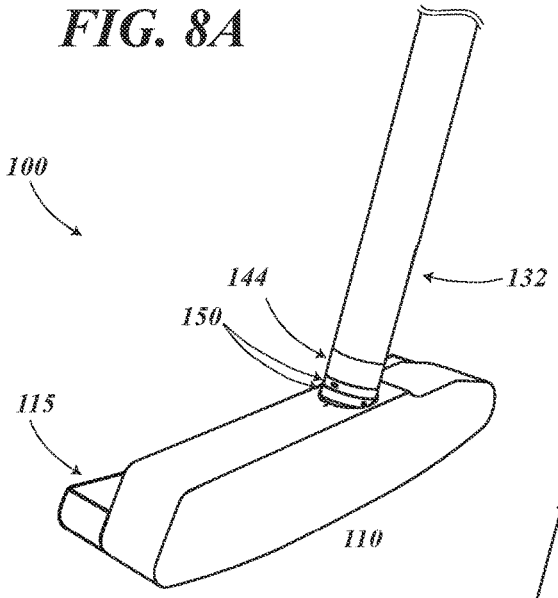
FIG. 8A illustrates an assembled isometric cutaway view of a golf club, in this case a putter, having ahead with through head "center shafted" hosel port with a cylindrical multi-piece adjustable, modular hosel system, optional lower hosel adjustment spacers, hosel shaft connector, shaft and optional grip section (not shown), shown from the face of the club, nearer the toe.
Figure 8B:
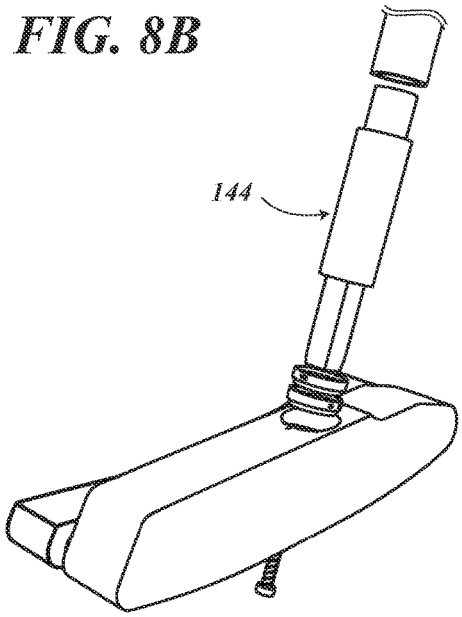
FIG. 8B illustrates an exploded isometric view of a golf club, in this case a putter, having a head with recessed hosel port in the top of the club head, a multi-piece adjustable, modular hosel system, optional lower hosel adjustment spacers, hosel shaft connector, shaft and optional grip section (not shown), shown from the face of the club.
Figure 8C:
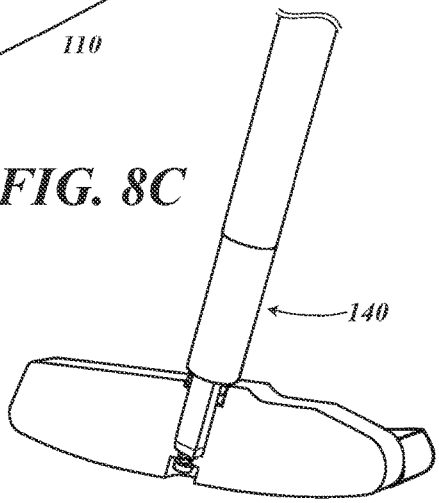
FIG. 8C illustrates an assembled cutaway isometric view from nearer the heal of a golf club, in this case a putter, having a head with recessed hosel port in the top of the club head with at least one flat to engage and restrict the hosel shaft connector piece, a multi-piece adjustable, modular hosel system, optional lower hosel adjustment spacers, hosel shaft connector, shaft and optional grip section (not shown), shown from the face of the club.
Figure 8D:
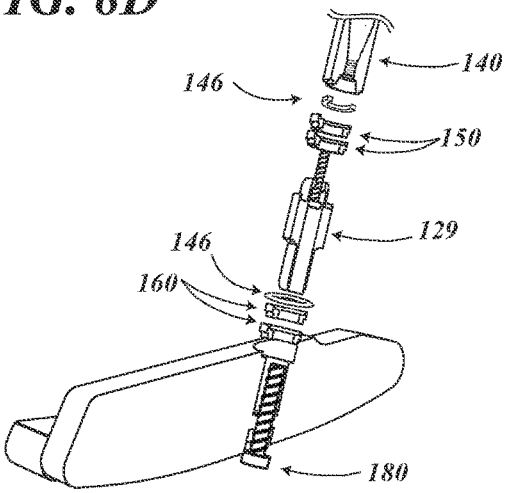
FIG. 8D illustrates an exploded cutaway isometric view from nearer the toe of a golf club, in this case a putter, having a head with recessed hosel port in the top of the club head with at least one flat to engage and restrict the hosel shaft connector piece, a multi-piece adjustable, modular hosel system, optional lower hosel adjustment spacers, hosel shaft connector, optional screw retaining ring, optional locking washer, mechine screw shaft and optional grip section (not shown)
Figure 8E:
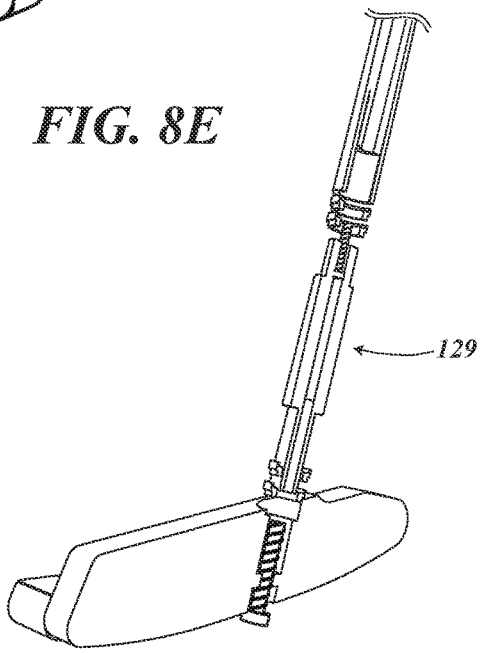
FIG. 8E illustrates an exploded cutaway isometric view from nearer the toe of a golf club, in this case a putter, having a head with recessed hosel port in the top of the club head with a flat to engage and restrict the hosel shaft connector piece, a multi-piece adjustable, a modular hosel system, optional lower hosel adjustment spacers, hosel shaft connector, small machine screw to connect the mid hosel section and the hosel shaft connector, and a large machine screw to connect the head and the lower portion of the hosel section, and optional grip section (not shown)

FIG. 8A illustrates a golf club 100 with a shaft tip 132, a hosel shaft connector piece 144, a pair of cylindrical lower hosel adjustment spacers 160 a head 110 and a flange 115. FIG. 8B illustrates an exploded view of the same club, showing the same components and their relationship to one another, plus the addition of optional gaskets. FIG. 8C illustrates the same club in an assembled cutaway view from nearer the heel. FIG. 8D shows an alternative embodiment of a center shafted putter design with a hosel shaft connector 140, a pair of upper adjustment spacers 150, an upper connection screw 170, a hosel mid-section 129, a pair of lower adjustment spacers 160 the head 110 and flange 115 and lower connection screw 180. FIG. 8E illustrates yet another embodiment showing an optional longer length hosel mid-section 129. An alternative embodiment replaces the upper screw 170 and lower screw 180 with a long bolt connecting the head 110 to the hosel shaft connector piece 140. It is contemplated that the hosel mid-section could take many shapes to provide different hosel geometries, including curved to provide more offset, lie angle and balance adjustment options. In such cases, the upper screw could be made of a flexible steel cable with threaded terminal end and drive head end permanently affixed by welding for instance.

Figure 9A:
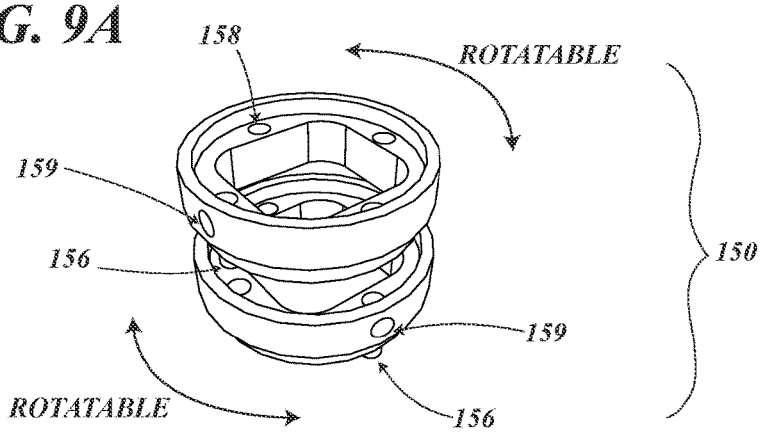
FIG. 9A illustrates an isometric exploded view of a selection of alternative design optional adjustment spacers, shown here positioned above one another, where the upper female mortised section has a number of locating ports in the recessed lower floor wall, and on the opposing lower male sides have at least one locating pin.
Figure 9B:
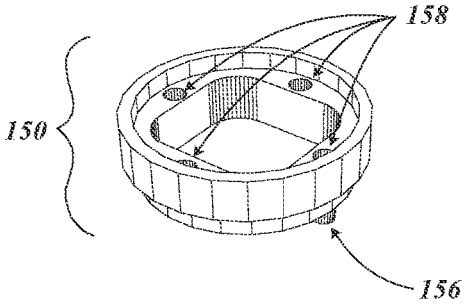
FIG. 9B illustrates an alternative design for the adjustment spacers where a locating pin in the under side of the male tenon joint mates with a series of locator pin holes in the upper female mortised joint in the clubhead, hosel or hosel shaft connector piece section and the head hosel.
Figure 9C:
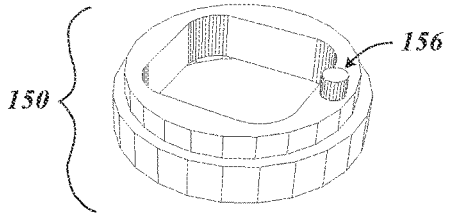
FIG. 9C illustrates an isometric view of the underside of an alternative design adjustment spacers, where the male mortised section has a locating pin extending from the lower floor wall.
Figure 9D:
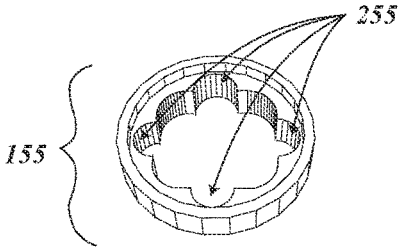
FIG. 9D illustrates an isometric view of the upper side of an alternative design adjustment spacer with a round exterior and modified round cornered square interior wall, where a series of notches are formed in the sides of the walls forming the interior dimension of the spacer.
Figure 9E:
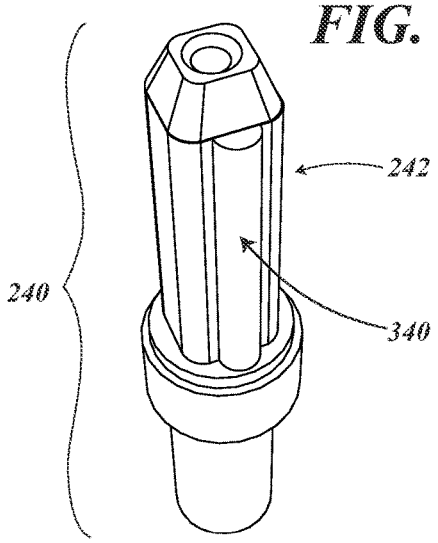
FIG. 9E illustrates an isometric view of an alternative design hosel shaft connector piece with a modified round cornered square exterior male adapter, where an external rib is located on one of the flat sides of the adaptor.

FIG. 9A illustrates an alternative embodiment of a set of cylindrical adjustment spacers 150 with a locating pin 156 in each spacer's lower wall. The degree of angle change can be seen in markings 159 on the side of the spacer where the angle change is oriented. The pins 156 engage with pin ports 158 to allow precise location of the spacers in relation to the golf club and other modular hosel components and help lock the entire system in place for use. FIG. 9B shows a single spacer from 9A, where the features including the pin ports, in this case four pin ports 158 can more easily be seen. FIG. 9C shows the underside of the same spacer where the locating pin 156 can more clearly be seen. FIG. 9D illustrates another alternative embodiment of the adjustment spacer 155 where indents or notches 255 are formed in the interior side walls of the spacer that engage with the hosel shaft connector piece, for instance. FIG. 9E illustrates a matching alternative embodiment hosel shaft connector piece 240 that features a rib 340 on the exterior of the hosel shaft connector stem 242 that will mate with and ride inside the curved notches 255 in the adjustment spacer 155 shown in FIG. 9D.

Figure 10A:
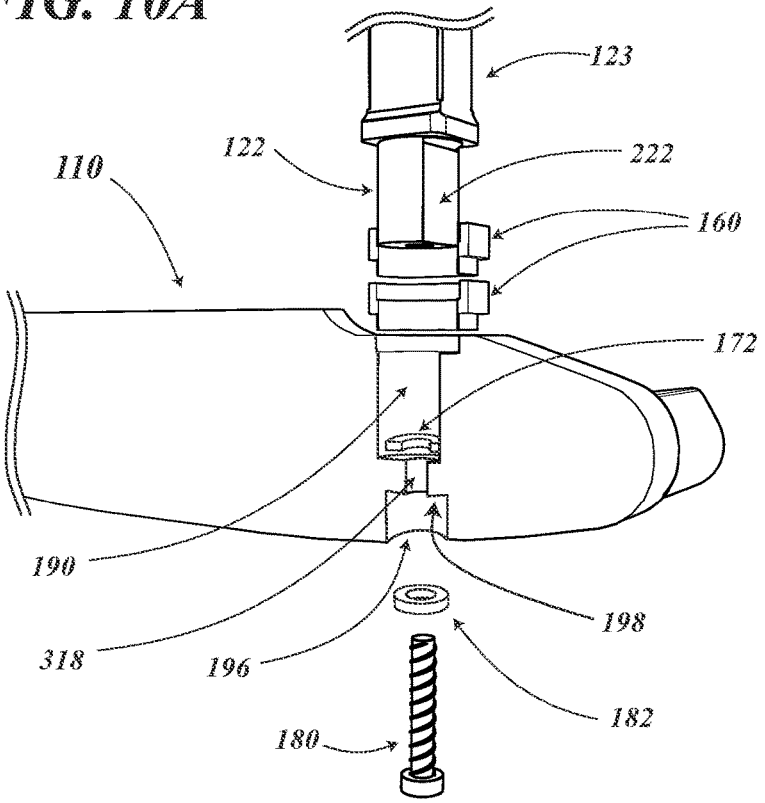
FIG. 10A illustrates a close up isometric exploded cutaway view of hosel in head port construction, including an orientation flat on the hosel stem, a corresponding locating flat in the head's hosel port, as well as optional washer and screw retaining rings in the construction.

FIG. 10A illustrates a cutaway close up view of hosel in head port construction showing the hosel shank 123, hosel lower stem 122, hosel lower stem flat 222, a pair of optional lower adjustment spacers 160, a head hosel port 190, an optional lower connection screw retaining ring 172 (cut away), a hosel port connection screw through bore 318, a washer 182 and a lower connection screw 180.

As can be seen in the close up cutaway view in FIG. 10A, the counter bore 196 is preferably made with an end mill, where the cutting edges of the tool extend further at the ends and shallower toward the middle, which is common for these tools, and thus produces a convex upper wall 198 to the counter bore 196. Some putters have hosel connection screw port counter bores that are deeper on the outside of the counter bore and are more shallow towards the center through bore. This creates a semi-convex surface for the screw head, or washer to contact, and facilitates the various angles the screw is positioned in when the angled spacers change the axis of the hosel and shaft, providing a larger surface area and less load bearing stresses on the screw head and shank and/or washer or locking washer.

Figure 10B:
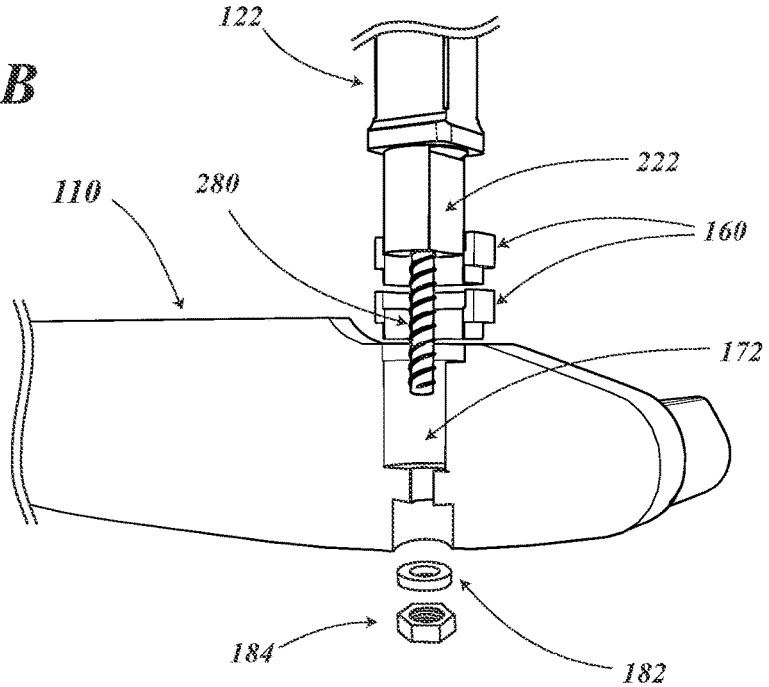
FIG. 10B illustrates a close up isometric exploded cutaway view of an alternative hosel in head port construction, including an orientation flat on the hosel stem, a corresponding locating flat in the head's hosel port, an alternative screw located at the base of the lower hosel stem, as well as optional washer, and locking nut in the construction.

FIG. 10B shows an alternative embodiment, utilizing a screw 280 inserted into or formed with the hosel stem 122, shown inside the head's hosel port 172, and optional adjustment spacers 160. An optional washer 182 or locking washer (not shown) can be utilized in the construction with a nut or locking nut used to complete the assembly for use. An alternative to a bolt 181 or screw 180 would be a hosel shaft connector piece or portion of the shaft tip that is stepped down and threaded and replaces the reverse direction bolt, but still being assembled with a nut, locking nut, nut and locking washer, etc.

Alternately, a pin, set screw or key can be inserted from the outside, for instance the face, back or heel, or from an adjacent position on the sole, to orient and secure the hosel in a redundant manner from the main central screw connection. Alternatively, the stem could be firmly affixed with a latch or tab, a locating pin or pins, one or more set screws either with or without the use of a flat, channel or rib associated with or within the mortised section between the stem and the head hosel port sections.

As an alternative to a modular hosel, the shaft, or optional shaft tip connector can be a female "shaft over" version that connects to a male spud or stud that is either formed as part of the head or affixed or connected to the head. If the later connected version, the stud can be connected from the side or underneath the head and thus be interchangeable for length, for instance, providing similar benefits to the hosel connected through a port in the heel of the head as previously described.

The addition of additional spacer sections to the upper and/lower hosel portion are performed in a "fixed" manner with a specialized tool as dictated by the rules of golf so it can be deemed conforming under the Rules of Golf. To make the assembly conforming to the current Rules of Golf as administered by the USGA and R&A, and secured for continuous play and lessening the chance of the screw working loose, a small amount of epoxy can be placed on the tip of the screw after all changes are made to the configuration of components. Alternatively, a thread locking compound such as Locktite® brand thread locker can be placed on the screw tip. For additional strength and durability, epoxy can be used inside the lower hosel and/or upper hosel ports to provide a semi-permanent construction. Some customers may prefer this solution once all specifications have been fit and if they don't intend to make adjustments afterwards. However, these epoxy bonds can be heated and disassembled later if so desired.

Referring back to FIG. 3A shows an embodiment with a modified design of the lower hosel stem 122 that provides a user-adjustable construction wherein the hosel can only be assembled in the correct orientation with the head. This is necessitated by Rules of Golf that require all forms of adjustment to be within conforming specifications, including the orientation of hosel and especially shaft lean in relation to the striking face, if the parts are to be user-adjustable. In particular, the Rules do not allow a club's shaft to lean forward or rearward more than 10 degrees. Therefore, a flat, rib, key, pin, screw, channel or other similar feature will restrict the orientation of the hosel to the correct alignment only, while still allowing the optional spacers to be assembled, rotated and adjusted without restriction.

The exterior rounded comer square matches closely visually with traditional hosel square or rectangular stem shape. A square with rounded comers facilitates milling the internal section to mate with the male stem and have large flats to resist twisting. Alternate means for locating and assembling the hosel section inside the head can also be utilized, especially where a bent-neck, plumber neck and the like are selected and for USGA conformance for user-adjustability, such as a key, tab, pin, set screw, bolt, bolts, screw or screws. A rectangular mortice joint can be used as an alternative to the square spacer with rounded comers. However, a rectangular solution is not as efficient as the adjustment spacers would have to be made differently for loft and lie adjustments since they couldn't be orientated in all four directions for stronger or weaker loft or for upright or flat lie angles.

One embodiment is to manufacture the upper hosel shaft tip connector from lightweight aerospace quality alloys such as 6061, 2024 or 7075 Aluminum Alloy, preferably heat treated and then anodized after manufacture for added strength and durability. Other materials such as steel, titanium, titanium alloy, bronze, aluminum bronze, graphite composite, tungsten, ceramic, metal matrix composite or magnesium or other material compositions can be utilized for weight and strength advantages.

The upper spacer adjuster sections are preferably turned on a precision lathe, such as a tool room lathe or engine lathe, or most preferably a CNC lathe. Bar stock raw material, such as 303 Stainless Steel, can be used where the outside diameter is the same net size of the finished product, and then the stepped down sections are turned down on the lathe and then parted off. Live tooling can be used to cut the inner mortised sections or those can be cut in a secondary operation on a manual or CNC mill for instance. Alternatively, the upper hosel adjustable spacers could be extruded with around or other shaped exterior, and around cornered square or other shape inner shape into a hollow tube or hollow bar stock that is then milled or turned and parted into the final shape. Another alternative manufacturing process would be to precision cast the parts.

The lower spacer adjuster sections are preferably milled in a milling center, such as a CNC vertical or horizontal machining center, and commonly available bar stock is used to make a number of adjustment spacers at one time in a vice in the machining center or in a special fixture. Bar stock raw material, such as 303 Stainless Steel, can be used where the outside dimension is near net to the max dimension of the finished part, and minimal machining time is needed and there is low waste and fewer chips to be recycled. By milling all the squares flat upper surfaces, the changes can all be made in a second and final operation limiting setup and down time. Alternatively, the sides of the female mortised joint and/or the sides of the male tenon section can be machined with a slight taper to facilitate a tight bond between the parts when the screw or other tightening connection mechanism is employed. Alignment markings can be engraved during the final milling operation to permanently identify the angle orientation on the exterior surfaces of the various components.

Alternatively, the lower adjustment spacers could also be turned on a lathe or CNC lathe. If the raw round bar stock's outer diameter is the same net size of the rounded corners of the finished product, and then the flat side sections could be milled off with live tooling on the lathe and then parted off. Live tooling can be used to cut the inner mortised sections or those can be cut in a secondary operation on a manual or CNC mill for instance.

Alignment markings, graphics and other information and designs can be engraved, laser engraved, stamped or printed on the exterior surfaces of the various components in the assembly. Paint can be applied to the stamped or engraved portions to make them more visible.

Having thus described the subject matter by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the disclosure may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the disclosure.

The invention claimed is:

1. A golf club assembly, comprising, in combination:

a discrete head portion having a hosel port;

an interchangeable modular hosel portion having a hosel cup at its upper end;

a combination of a shaft and a grip attached to the shaft forming a shaft and grip portion having an axis;

a first discrete upper hosel adjustment spacer portion positioned along the axis between the upper end of the hosel cup and the shaft and grip portion, wherein the first discrete hosel adjustment portion has a top female mortised recess, the top female mortised recess having an opening along a first plane, and a male tenon section, the male tenon section having an opening along a second plane; and a second discrete lower hosel adjustment spacer portion positioned between the interchangeable modular hosel portion and the discrete head portion;

the interchangeable modular hosel portion adapted to receive and retain accessibly and adjustably the first and second discrete hosel adjustment spacer portions.

2. The assembly as described in claim 1 wherein the first discrete hosel adjustment spacer portion has a spacer length that differs from a length of the second discrete hosel adjustment spacer portion.

3. The assembly as described in claim 1 wherein the first discrete hosel adjustment spacer portion has a spacer length and angle that differ from a length and angle of the second discrete hosel adjustment spacer portion.

4. The assembly as described in claim 1 wherein the discrete head portion is associated with one of: a putter type club head, an iron type club head, a hybrid wood-iron type club head, and a wood type club head.

5. The assembly as described in claim 1 wherein each of the first and second discrete hosel adjustment spacer portions includes a length, and a shaft axis to head offset, at least one of the first and second discrete hosel adjustment spacer portions includes one of a different length, and a different shaft axis to head offset.

6. The assembly as described in claim 1 wherein the first discrete hosel adjustment spacer portion has a characteristic that differs from the characteristic of the second discrete hosel adjustment spacer portion, the characteristic being one of: axis angle, length, material, weight, and marking.

7. The assembly as described in claim 1 wherein at least one of the first and second discrete hosel adjustment spacer portions comprises a round-cornered square exterior geometry having a mortised joint, and a round inner pass-through port.

8. The assembly as described in claim 1 wherein the first plane and the second plane are parallel or non-parallel to one another.

9. The assembly as described in claim 1 wherein the shaft and grip portion is interchangeable with a second shaft and grip portion.

* * * * *